US007306302B2

(12) United States Patent
Becke et al.

(10) Patent No.: US 7,306,302 B2
(45) Date of Patent: Dec. 11, 2007

(54) STORAGE COMPARTMENT FOR A REFRIGERATOR DOOR

(75) Inventors: Christoph Becke, Grosskarolinenfeld (DE); Silvia Gerstner, Langenau (DE); Siegfried Grasy, Dornstadt (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 0 days.

(21) Appl. No.: 11/399,998

(22) Filed: Apr. 7, 2006

(65) Prior Publication Data

US 2006/0186775 A1 Aug. 24, 2006

Related U.S. Application Data

(60) Division of application No. 10/816,374, filed on Apr. 1, 2004, which is a continuation of application No. PCT/EP02/10600, filed on Sep. 20, 2002.

(30) Foreign Application Priority Data

Oct. 1, 2001 (DE) ..... 201 16 093 U

(51) Int. Cl.
*A47B 96/04* (2006.01)

(52) U.S. Cl. ..... 312/405.1

(58) Field of Classification Search ..... 312/401, 312/405, 405.1, 321.5, 348.3; 62/377; 211/74
See application file for complete search history.

(56) References Cited

U.S. PATENT DOCUMENTS 3,220,558 A * 11/1965 Olsson ..... 211/74
3,990,617 A * 11/1976 Carter ..... 224/251

FOREIGN PATENT DOCUMENTS

DE 9014463 * 2/1991
JP 2001-74359 * 3/2001

* cited by examiner

*Primary Examiner*—James O. Hansen
(74) *Attorney, Agent, or Firm*—Russell W. Warnock; Craig J. Loest; James E. Howard

(57) ABSTRACT

A storage compartment for a refrigerator door has a box-shaped body and a compartment divider. The compartment divider can be attached to a longitudinal wall of the box-shaped body and extends over more than half of a depth of the box-shaped body. A space for holding small items is provided by the compartment divider.

10 Claims, 2 Drawing Sheets

STORAGE COMPARTMENT FOR A REFRIGERATOR DOOR

CROSS-REFERENCE TO RELATED APPLICATION

This application is a divisional of co-pending U.S. application Ser. No. 10/816,374, filed Apr. 1, 2004, which was a continuation of international application No. PCT/EP02/10600, filed Sep. 20, 2002, which claimed priority to German patent application No. 201 16 093.5, filed Oct. 1, 2001; the prior applications are herewith incorporated by reference in their entirety.

BACKGROUND OF THE INVENTION

Field of the Invention

The present invention relates to a storage compartment for fitting to a door of a refrigerator. Storage compartments such as these, in particular those which are mounted in the lower area of the inside of the door, are used essentially for storage of drinks bottles and other containers for refrigerated items that are taller than they are broad.

If the door of the refrigerator is opened carelessly, there is a risk of containers such as these that are higher than they are broad to fall over. The containers are admittedly prevented from falling out by the storage compartments, which are generally in the form of boxes, having a sufficient wall height, but there is still a risk of a container falling over on its side within the storage compartment once it has been tilted.

In order to counter this risk, German Utility Model 86 32 853 discloses different numbers of hollow bodies being fitted to one sidewall of the storage compartment, which extend into the interior of the compartment and thus reduce its depth. By matching the compartment depth to the diameter of a container that is stored in it, it is possible to prevent the container from tilting. However, the use of these hollow bodies is inconvenient for the user and is thus in any case of interest for refrigerators which are subject to severe vibration, for example because they are carried on board a vehicle.

German Utility Model 90 14 463 and German Utility Model 85 11 568 each disclose a storage compartment for a door of a refrigerator which have a compartment divider which can be attached to a longitudinal wall of the storage compartment and extends in the depth direction of the body. A compartment divider such as this admittedly cannot prevent a container in the storage compartment from tilting if the refrigerator door is opened carelessly, but, provided that it is placed in a suitable manner in the vicinity of the container, it can prevent the container from falling over within the storage compartment.

However, a compartment divider such as this does not allow for space-saving accommodation of refrigerated items that are not or not overly stable in the vertical position, such as tubes. In order to allow items such as these to be stored, German Utility Model 90 14 463 recommends the use of insert boxes, which are suspended on a sidewall of the door storage compartment and extend over a small proportion of its depth. However, the insert boxes lead to inefficient use of the space in the storage compartment since the remaining depth of the storage compartment, which remains between a suspended container and the opposite side wall of the storage compartment, is too small for most container formats, and thus remains unused.

SUMMARY OF THE INVENTION

It is accordingly an object of the invention to provide a storage compartment for a refrigerator door that overcomes the above-mentioned disadvantages of the prior art devices of this general type, which simultaneously provides good stability for containers of different sizes that are taller than they are broad, and provides high-efficiency space utilization.

With the foregoing and other objects in view there is provided, in accordance with the invention, a storage compartment for a refrigerator door. The storage compartment contains a box-shaped body having a longitudinal wall and a given depth, and a compartment divider attached to the longitudinal wall and extends over more than half of the given depth. The compartment divider defines a chamber for holding small items.

The object is achieved in that the compartment divider is itself used to accommodate on it a chamber for holding small items.

The compartment divider preferably extends essentially over the entire depth of the storage compartment, so that the small item compartment can also extend essentially over this depth.

The extent of the compartment divider in the depth direction of the storage compartment is preferably greater than in its width direction, because refrigerated items with a base area which is equal to or larger than the depth of the storage compartment need not be accommodated in a separate small parts compartment in order to increase their stability.

The small items compartment preferably has an open base so that no dirt can gather in it. Items that are placed in the small items compartment are supported only by its walls or by its walls and the base of the storage compartment.

In order to allow the compartment divider to be stored in a space-saving manner when it is not being used, its height is preferably less than that of the storage compartment.

The compartment divider may be provided with a rider that can be placed over the longitudinal wall in order to attach it to the longitudinal wall of the storage compartment. In order to guarantee that the compartment divider is seated firmly on the longitudinal wall, at least one vertical rib is preferably formed on one inner surface of the rider. This can firmly clamp in the sidewall, if it is flat, so that the position of the compartment divider in the storage compartment is infinitely variable. The sidewall of the storage compartment may, however, also be provided with two or more grooves which are complementary to the at least one rib and in which the rib can engage.

In order to secure objects that are placed in the side of the compartment divider against tilting over as well, two or more vertical ribs may be provided on the outer walls of the compartment divider.

Other features which are considered as characteristic for the invention are set forth in the appended claims.

Although the invention is illustrated and described herein as embodied in a storage compartment for a refrigerator door, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
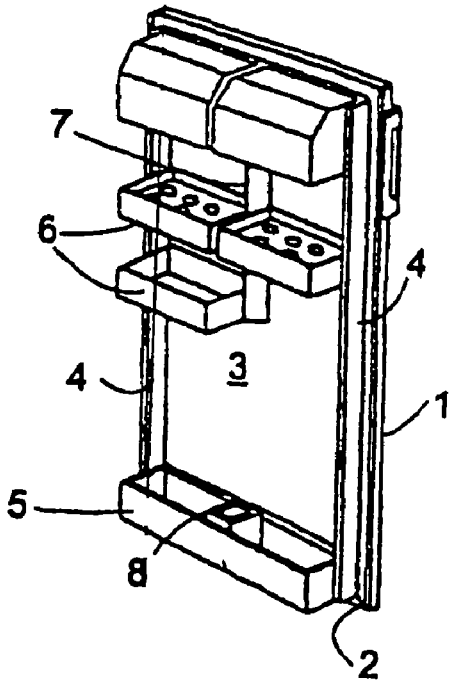
FIG. 1 is a perspective internal view of a door of a refrigerator with a storage compartment according to the invention.

Referring now to the figures of the drawing in detail and first, particularly, to FIG. 1 thereof, there is shown a refrigerator door 1 which is illustrated in simplified form in FIG. 1. The door 1 is normally equipped with a magnetic seal 2 disposed on its inner wall and has vertical bars 4, which project close to the edge, on its inner face 3. A box-shaped door storage compartment 5, whose width corresponds to the distance between the two bars 4, is disposed between the two bars 4 on a lower edge area of the refrigerator door 1. Further, narrower door storage compartments 6 are each suspended in an upper area of the door 1 between one of the bars 4 and an additional, shorter bar 7, which extends over the center of the inner face 3.

The door storage compartment 5 is used primarily for storing bottles and other refrigerated item containers that are taller than they are broad. In order to secure them in the standing position and also to make it possible to use the compartment 5 for space-saving storage of relatively small objects, in particular tubes, a compartment divider 8 is suspended on one side wall of the compartment 5, and its configuration can be seen better in FIG. 2, which shows a plan view of the door storage compartment 5.

Figure 5:
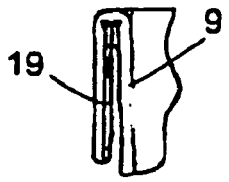
FIG. 5 is an enlarged, sectional view showing a detail from FIG. 4.

The compartment divider 8 is formed essentially from a four-sided frame with two short sidewalls 9, 10 and two long sidewalls 11, which surround a chamber 17. The short side walls 9 each face longitudinal walls 12, 13 of the door storage compartment 5, and the long side walls 11 extend over the majority of the depth, in this case about 80%, of the door storage compartment 5. A rider 14 is integrally formed on the sidewall 9, engages in a longitudinal slot 15 in the side wall 12, and is held on the sidewall 12 by a friction lock. The shape of the rider 14 is illustrated in more detail in conjunction with a second exemplary embodiment in FIGS. 4 and 5.

Figure 3:
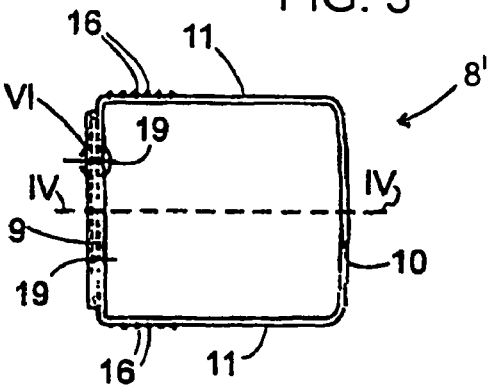
FIG. 3 is a plan view of a second refinement of a compartment divider for the storage compartment.

FIG. 3 shows a plan view of a compartment divider 8' based on a second exemplary embodiment. The frame of the compartment divider 8', which is formed from the sidewalls 9, 10, 11, is virtually, but not exactly, square. The two longer side walls 11 are fitted on their outer faces with two or more flat ribs 16, which are provided in order to increase the friction between a non-illustrated container, which is placed in the door storage compartment 5 outside the compartment divider 8' and is clamped in by the compartment divider 8', and the side wall 11, and in order thus additionally to secure the container against tilting.

Figure 4:
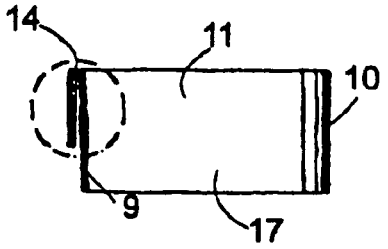
FIG. 4 is a vertical sectional view through the compartment divider shown in FIG. 3.

FIG. 4 shows a vertical section through the compartment divider shown in FIG. 3 taken along the line IV-IV in FIG. 3. FIG. 4 shows that the rider 14 is essentially in the form of an elongated hook with a tongue that extends parallel to the sidewall 9, and at a short distance from it. A rib 19 extends over the entire length of the tongue on its surface facing the sidewall 9. The chamber 17 is open at the bottom. The height of the compartment divider 8 corresponds approximately to half to two-thirds of the height of the door storage compartment 5.

Figure 6:
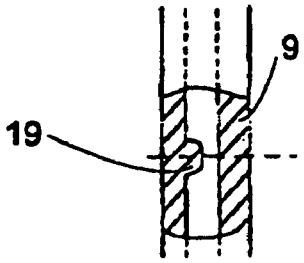
FIG. 6 is a sectional view showing a further enlarged detail of the compartment divider from FIG. 3.

FIG. 6 shows an enlarged horizontal section through the area marked VI in FIG. 3, showing the sidewall 9, the tongue and the rib 19. A second rib 19 is provided symmetrically with respect to the plane IV-IV on the tongue.

Figure 2:
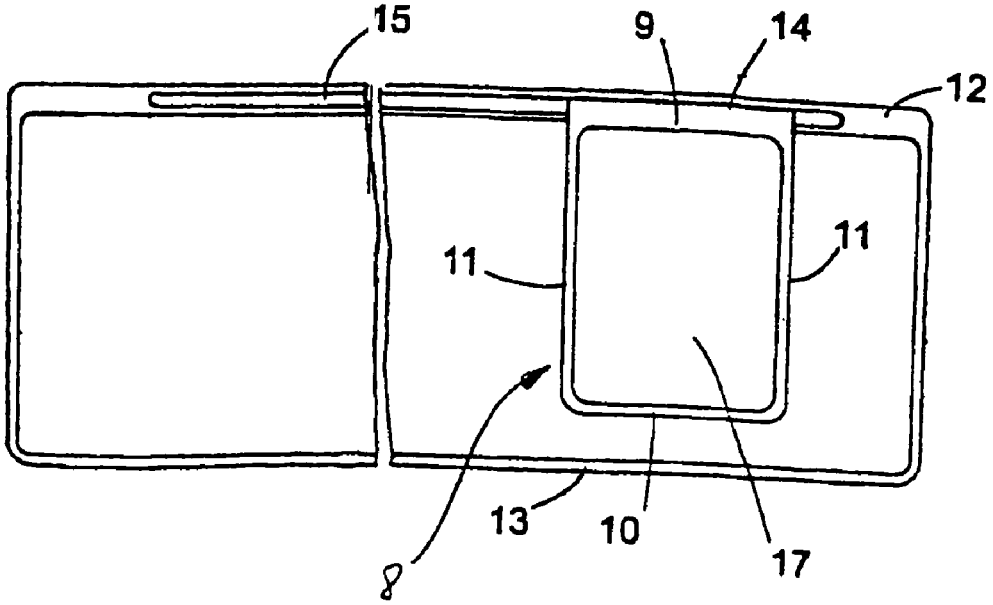
FIG. 2 is a plan view of the storage compartment.

The purpose of the two ribs 19 is on the one hand to ensure that the compartment divider 8, 8' is firmly seated such that it cannot be moved in the width direction of the door storage compartment 5 by objects stored in it, but on the other hand to allow the compartment divider 8, 8' to be easily fitted to and removed from the sidewall 12 in the vertical direction. As is shown in FIG. 2, the sidewall 12 may for this purpose be flat or may be provided with grooves or ripples that are complementary to the ribs. The slot 15 may also be omitted; in this case, the tongue must, for example, engage in a gap provided between the outer wall and the door inner surface 3 on the outer surface of the wall 12.

Figure 7:
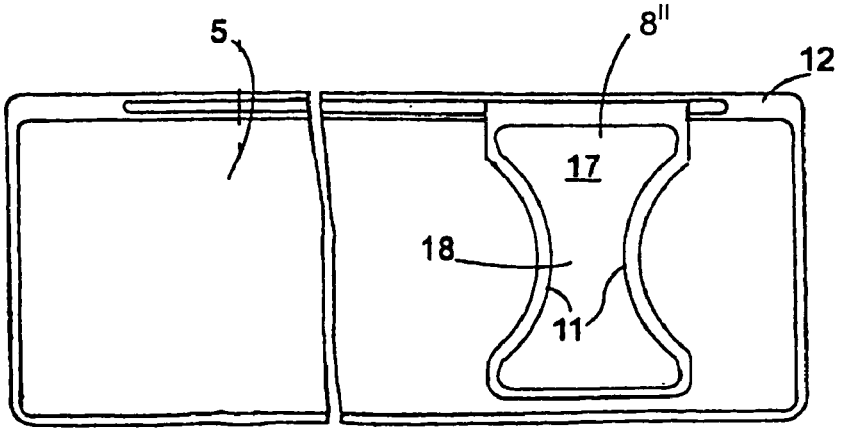
FIG. 7 is a plan view of a storage compartment with a compartment divider according to a third refinement of the invention.

FIG. 7 shows a third exemplary embodiment of the door storage compartment according to the invention, which differs from that shown in FIG. 2 by the shape of the long side walls 11 of a compartment divider 8". In the exemplary embodiment shown in FIG. 7, the long sidewalls 11 are in the form of circular arcs with a diameter that corresponds approximately to the depth of the door storage compartment 5. This refinement occupies only a small amount of space between two large round objects which are placed in the compartment, such as bottles, and at the same time allows one individual narrow object or two objects with a predominantly round cross section, for example two tubes, to be stored at the same time in a space-saving manner, because they are stored vertically, which objects may each be inserted into the chamber 17 in front of or behind a central constriction 18 in the depth direction.

We claim:

1. A refrigerator door comprising:

a storage compartment connected to the refrigerator door and including a first longitudinal wall disposed adjacent to the refrigerator door, a second longitudinal wall spaced apart from the first longitudinal wall and extending substantially parallel to the first longitudinal wall, and a slot formed in the first longitudinal wall, the storage compartment having a width dimension extending along the first longitudinal wall in a substantially horizontal direction, a depth dimension extending between the first and second longitudinal walls, and a height dimension extending along the first longitudinal wall in a substantially vertical direction;

a compartment divider including a rider forming a substantially flat hook portion, the rider engaging the slot and restricting movement of the compartment divider with respect to the storage compartment along the width dimension; and wherein the rider includes at least one rib raised above a surface of the rider and extending in a substantially vertical direction and the slot includes at least one groove formed within the first longitudinal wall and recessed from the slot and extending in a substantially vertical direction, the at least one rib engaging the at least one groove to restrict movement of the compartment divider with respect to the storage compartment along the width dimension.

2. A refrigerator door comprising:

a storage compartment connected to the refrigerator door and including a first longitudinal wall disposed adjacent to the refrigerator door, a second longitudinal wall spaced apart from the first longitudinal wall and extending substantially parallel to the first longitudinal wall, and a slot formed in the first longitudinal wall, the storage compartment having a width dimension extending along the first longitudinal wall in a substantially horizontal direction, a depth dimension extending between the first and second longitudinal walls, and a height dimension extending along the first longitudinal wall in a substantially vertical direction;

a compartment divider including a rider forming a substantially flat hook portion, the rider engaging the slot and restricting movement of the compartment divider with respect to the storage compartment along the width dimension; and wherein the rider includes multiple ribs extending in a substantially vertical direction and the slot includes multiple grooves formed within the first longitudinal wall and extending in a substantially vertical direction, the multiple ribs engaging the multiple grooves to restrict movement of the compartment divider with respect to the storage compartment along the width dimension.

3. The refrigerator door according to claim 2, wherein the slot includes a plurality of grooves formed within the first longitudinal wall and extending in a substantially vertical direction and being spaced along the slot along the width dimension, the rider being disengagable from the slot in a substantially vertical direction and re-engagable at additional positions in the slot in which the ribs engage other corresponding grooves.

4. A refrigerator door comprising:

a storage compartment connected to the refrigerator door and including a first longitudinal wall disposed adjacent to the refrigerator door, a second longitudinal wall spaced apart from the first longitudinal wall and extending substantially parallel to the first longitudinal wall, and a slot formed in the first longitudinal wall, the storage compartment having a width dimension extending along the first longitudinal wall in a substantially horizontal direction, a death dimension extending between the first and second longitudinal walls, and a height dimension extending along the first longitudinal wall in a substantially vertical direction;

a compartment divider including a rider forming a substantially flat hook portion, the rider engaging the slot and restricting movement of the compartment divider with respect to the storage compartment along the width dimension;

wherein the compartment divider includes a first short sidewall disposed adjacent the first longitudinal wall and connected to the rider, a second short sidewall spaced apart from the first short sidewall, and two long sidewalls extending between the first and second short sidewalls on opposing sides of the compartment divider, the compartment divider defining a chamber formed within the first and second short sidewalls and two long sidewalls for receiving items; and wherein the compartment divider includes multiple flat ribs facing outwardly from the long sidewalls for frictionally engaging items within the storage compartment.

5. The refrigerator door according to claim 4, wherein the compartment divider has an open base below the chamber.

6. The refrigerator door according to claim 4, wherein the distance between the first short sidewall and the second short sidewall is greater than half the distance between the first longitudinal wall and the second longitudinal wall.

7. The refrigerator door according to claim 4, wherein the distance between the first short sidewall and the second short sidewall is greater the distance between the two long sidewalls.

8. A refrigerator door comprising:

a storage compartment connected to the refrigerator door and including a first longitudinal wall disposed adjacent to the refrigerator door, a second longitudinal wall spaced apart from the first longitudinal wall and extending substantially parallel to the first longitudinal wall, and a slot formed in the first longitudinal wall, the storage compartment having a width dimension extending along the first longitudinal wall in a substantially horizontal direction, a depth dimension extending between the first and second longitudinal walls, and a height dimension extending along the first longitudinal wall in a substantially vertical direction;

a compartment divider including a rider forming a substantially flat hook portion, the rider engaging the slot and restricting movement of the compartment divider with respect to the storage compartment along the width dimension wherein the rider includes multiple ribs extending in a substantially vertical direction and the slot includes multiple grooves formed within the first longitudinal wall and extending in a substantially vertical direction, the multiple ribs engaging the multiple grooves to restrict movement of the compartment divider with respect to the storage compartment along the width dimension; and wherein the compartment divider includes a first short sidewall disposed adjacent the first longitudinal wall and connected to the rider, a second short sidewall spaced apart from the first short sidewall, and two long sidewalls extending between the first and second short sidewalls on opposing sides of the compartment divider, the compartment divider defining a chamber formed within the first and second short sidewalls and two long sidewalls for receiving items.

9. The refrigerator door according to claim 8, wherein the compartment divider has an open base below the chamber.

10. The refrigerator door according to claim 8, wherein the compartment divider includes multiple flat ribs facing outwardly from the long sidewalls for frictionally engaging items within the storage compartment.

* * * * *